US008161750B2

(12) United States Patent
Simmons et al.

(10) Patent No.: US 8,161,750 B2
(45) Date of Patent: Apr. 24, 2012

(54) FUEL NOZZLE FOR A TURBOMACHINE

(75) Inventors: Scott Robert Simmons, Simpsonville, SC (US); Stephen Robert Thomas, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 745 days.

(21) Appl. No.: 12/355,263

(22) Filed: Jan. 16, 2009

(65) Prior Publication Data

US 2010/0180603 A1 Jul. 22, 2010

(51) Int. Cl.
*F02C 1/00* (2006.01)

(52) U.S. Cl. ..... 60/737; 60/742; 60/804; 60/748; 60/776

(58) Field of Classification Search ..... 60/748, 60/740, 742, 746, 747, 804, 737, 738, 752–760, 60/734, 736, 776; 239/399
See application file for complete search history.

(56) References Cited

U.S. PATENT DOCUMENTS

| | | | | |
|---|---|---|---|---|
| 4,023,351 | A * | 5/1977 | Beyler et al. | 60/742 |
| 4,938,418 | A | 7/1990 | Halvorsen | |
| 5,623,819 | A * | 4/1997 | Bowker et al. | 60/776 |
| 5,701,732 | A * | 12/1997 | Nesbitt et al. | 60/776 |
| 5,765,376 | A * | 6/1998 | Zarzalis et al. | 60/748 |
| 5,836,164 | A * | 11/1998 | Tsukahara et al. | 60/733 |
| 6,209,325 | B1 * | 4/2001 | Alkabie | 60/737 |
| 6,301,900 | B1 * | 10/2001 | Mandai et al. | 60/740 |
| 7,117,678 | B2 * | 10/2006 | Sampath et al. | 60/740 |
| 7,165,405 | B2 * | 1/2007 | Stuttaford et al. | 60/737 |
| 7,237,730 | B2 | 7/2007 | Prociw et al. | |
| 7,469,544 | B2 * | 12/2008 | Farhangi | 60/740 |
| 7,546,735 | B2 * | 6/2009 | Widener | 60/746 |
| 7,926,282 | B2 * | 4/2011 | Chew et al. | 60/748 |
| 7,926,744 | B2 * | 4/2011 | Thomson et al. | 239/405 |
| 7,966,820 | B2 * | 6/2011 | Romoser | 60/742 |
| 8,024,932 | B1 * | 9/2011 | Stewart | 60/748 |
| 8,028,529 | B2 * | 10/2011 | Venkataraman et al. | 60/752 |
| 8,079,218 | B2 * | 12/2011 | Widener | 60/742 |
| 2011/0197591 | A1 * | 8/2011 | Valeev et al. | 60/772 |

* cited by examiner

*Primary Examiner* — William H Rodriguez
(74) *Attorney, Agent, or Firm* — Cantor Colburn LLP

(57) ABSTRACT

A turbomachine includes a compressor, a turbine, and a combustor operatively connected to the turbine. The turbomachine further includes a cap member mounted to the combustor. The cap member includes a first surface and a second surface. A combustion chamber is defined within the combustor. An injection nozzle is supported at the second surface of the cap member. The injection nozzle includes a first end that extends through an inner flow path to a second end. The first end is configured to receive an amount of a first fluid and the second end is configured to receive an amount of a second fluid. A mixture of the first and second fluids is discharged from the second end of the injection nozzle.

18 Claims, 5 Drawing Sheets

FUEL NOZZLE FOR A TURBOMACHINE

BACKGROUND OF THE INVENTION

The subject matter disclosed herein relates to turbomachines and, more particularly, to a fuel nozzle for a turbomachine.

In general, gas turbine engines combust a fuel/air mixture which releases heat energy to form a high temperature gas stream. The high temperature gas stream is channeled to a turbine via a hot gas path. The turbine converts thermal energy from the high temperature gas stream to mechanical energy that rotates a turbine shaft. The turbine may be used in a variety of applications such as for providing power to a pump or an electrical generator.

In a gas turbine, engine efficiency increases as combustion gas stream temperatures increase. Unfortunately, higher gas stream temperatures produce higher levels of nitrogen oxide (NOx), an emission that is subject to both federal and state regulation. Therefore, there exists a careful balancing act between operating gas turbines in an efficient range, while also ensuring that the output of NOx remains below mandated levels. One method of achieving low NOx levels is to ensure good mixing of fuel and air prior to combustion.

BRIEF DESCRIPTION OF THE INVENTION

According to one aspect of the invention, a turbomachine includes a compressor, a turbine, and a combustor operatively connected to the turbine. The turbomachine further includes an end cover mounted to the combustor, and a cap member positioned within the combustor. The cap member includes a first surface and a second surface. A combustion chamber is defined within the combustor. In addition, at least one injection nozzle is supported at the second surface of the cap member. The at least one injection nozzle includes a main body having a first end that extends through an inner flow path to a second end. The first end is configured to receive an amount of a first fluid and the second end is configured to receive an amount of a second fluid. The second end discharges a mixture of the first and second fluids from the injection nozzle into the combustion chamber.

According to another aspect of the invention, an injection nozzle for a turbomachine includes a main body having a first end that extends through an inner flow path to a second end. The first end is configured to receive an amount of a first fluid and the second end is configured to receive an amount of a second fluid. The second end discharges a mixture of the first and second fluids from the injection nozzle into a combustion chamber.

According to yet another aspect of the invention, a method of introducing a combustible mixture of a first and second fluid into a turbomachine nozzle including a main body having a first end that extends through an inner flow path to a second end mounted to a cap member includes guiding a first fluid through the first end of the injection nozzle. A second fluid is introduced into the injection nozzle from the second end. The first and second fluids are mixed within the inner flow path to form a combustible mixture. The combustible mixture is passed through the second end into a combustion chamber.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

The terms "axial" and "axially" as used in this application refer to directions and orientations extending substantially parallel to a center longitudinal axis of a centerbody of a burner tube assembly. The terms "radial" and "radially" as used in this application refer to directions and orientations extending substantially orthogonally to the center longitudinal axis of the centerbody. The terms "upstream" and "downstream" as used in this application refer to directions and orientations relative to an axial flow direction with respect to the center longitudinal axis of the centerbody.

Figure 1:
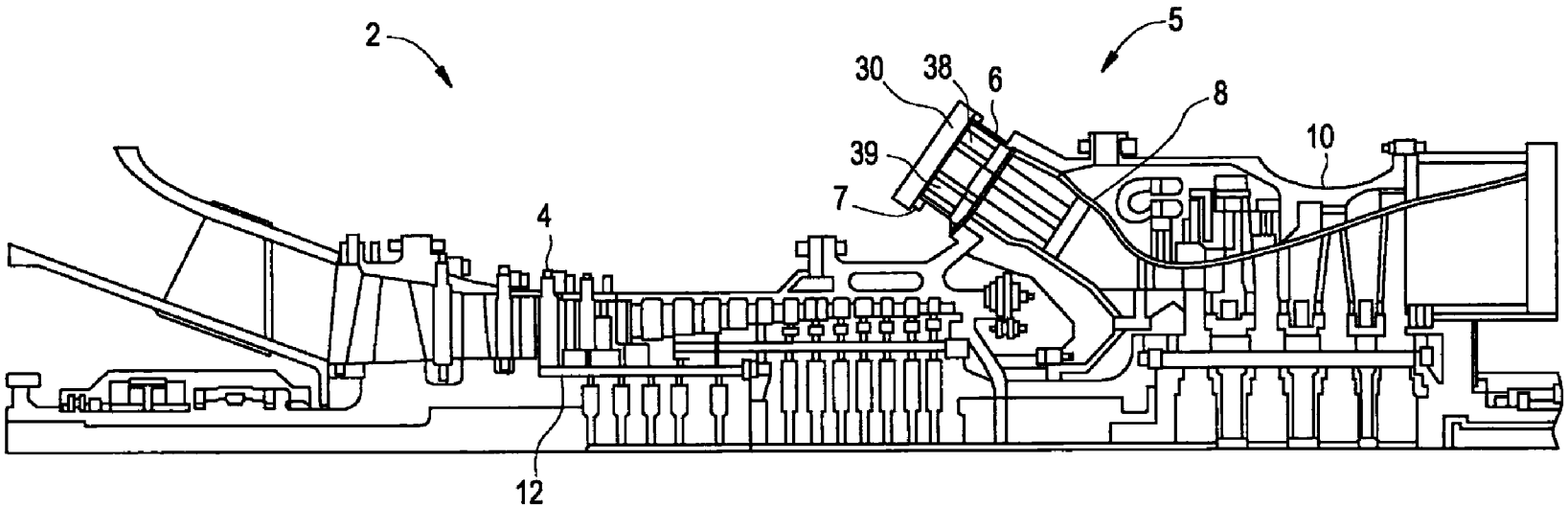
FIG. 1 is a cross-sectional side view of a turbomachine including a nozzle formed in accordance with exemplary embodiments of the invention.

With initial reference to FIG. 1, a turbomachine constructed in accordance with exemplary embodiments of the invention is generally indicated at 2. Turbomachine 2 includes a compressor 4 and a combustor assembly 5 having at least one combustor 6 provided with a fuel nozzle or injector assembly housing 8. Turbomachine engine 2 also includes a turbine 10 and a common compressor/turbine shaft 12. In one embodiment, gas turbine engine 2 is a PG9371 9FBA Heavy Duty Gas Turbine Engine, commercially available from General Electric Company, Greenville, S.C. Notably, the present invention is not limited to any one particular engine and may be used in connection with other gas turbine engines.

Figure 2:
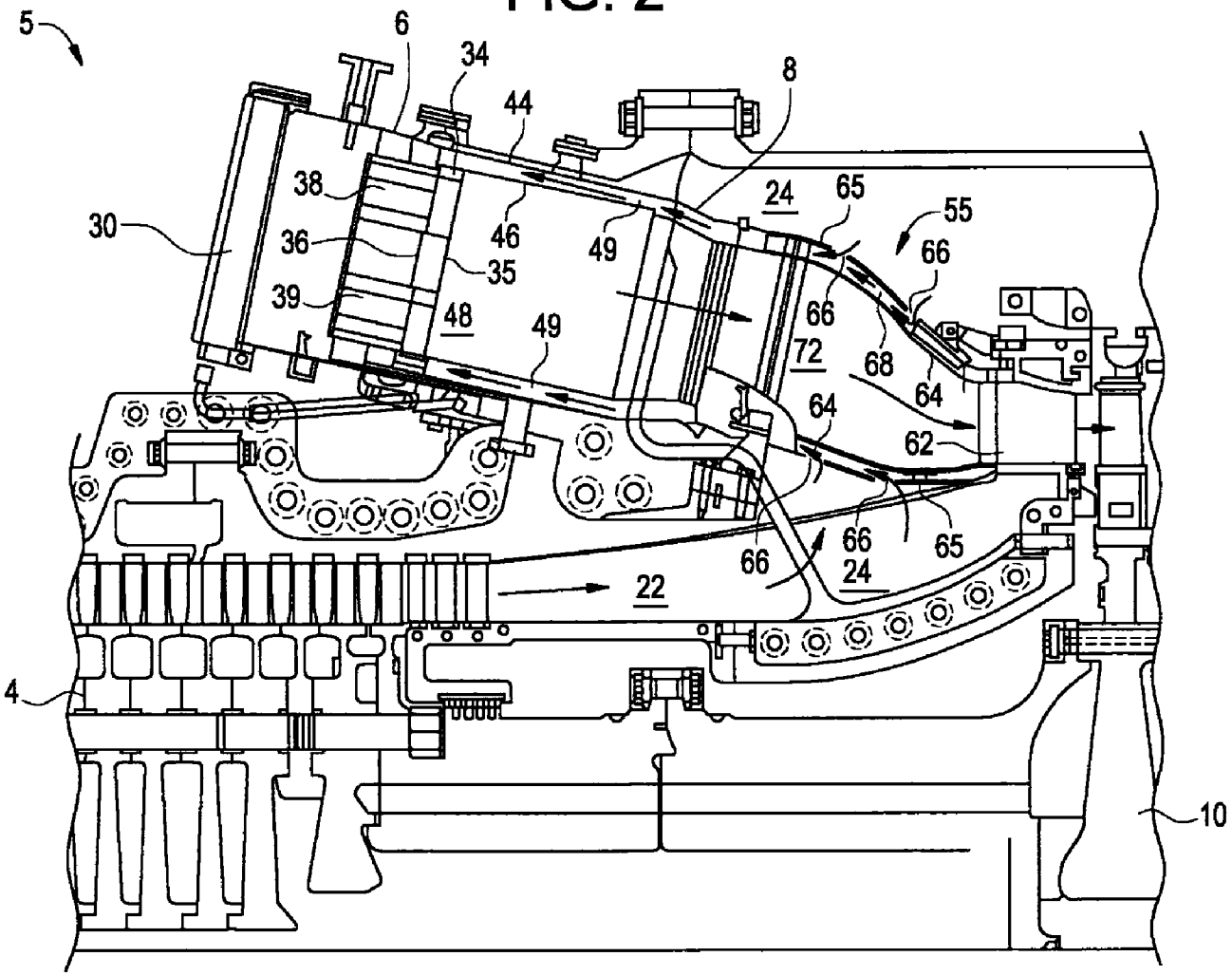
FIG. 2 is a cross-sectional view of a combustor portion of the turbomachine of FIG. 1.

As best shown in FIG. 2 combustor 6 is coupled in flow communication with compressor 4 and turbine 10. Compressor 4 includes a diffuser 22 and a compressor discharge plenum 24 that are coupled in flow communication with each other. Combustor 6 also includes an end cover 30 positioned at a first end thereof, and a cap member 34. Cap member 34 includes a first surface 35 and an opposing second surface 36. As will be discussed more fully below, cap member 34, and more specifically, first surface 35 provides structural support to a plurality of fuel or injection nozzle assemblies 38 and 39. Combustor 6 further includes a combustor casing 44 and a combustor liner 46. As shown, combustor liner 46 is positioned radially inward from combustor casing 44 so as to define a combustion chamber 48. An annular combustion chamber cooling passage 49 is defined between combustor casing 44 and combustor liner 46. A transition piece 55 couples combustor 6 to turbine 10. Transition piece 55 channels combustion gases generated in combustion chamber 48 downstream towards a first stage turbine nozzle 62. Towards that end, transition piece 55 includes an inner wall 64 and an outer wall 65. Outer wall 65 includes a plurality of openings 66 that lead to an annular passage 68 defined between inner wall 64 and outer wall 65. Inner wall 64 defines a guide cavity 72 that extends between combustion chamber 48 and turbine 10.

During operation, air flows through compressor 4 and compressed air is supplied to combustor 6 and, more specifically, to injector assemblies 38 and 39. At the same time, fuel is passed to injector assemblies 38 and 39 to mix with the air and form a combustible mixture. The combustible mixture is channeled to combustion chamber 48 and ignited to form combustion gases. The combustion gases are then channeled to turbine 10. Thermal energy from the combustion gases is converted to mechanical rotational energy that is employed to drive shaft 12.

More specifically, turbine 10 drives compressor 4 via shaft 12 (shown in FIG. 1). As compressor 4 rotates, compressed air is discharged into diffuser 22 as indicated by associated arrows. In the exemplary embodiment, the majority of air discharged from compressor 4 is channeled through compressor discharge plenum 24 towards combustor 6, and the remaining compressed air is channeled for use in cooling engine components. Compressed air within discharge plenum 24 is channeled into transition piece 55 via outer wall openings 66 and into annular passage 68. Air is then channeled from annular passage 68 through annular combustion chamber cooling passage 49 and to injection nozzle assemblies 38 and 39. The fuel and air are mixed forming the combustible mixture that is ignited forming combustion gases within combustion chamber 48. Combustor casing 44 facilitates shielding combustion chamber 48 and its associated combustion processes from the outside environment such as, for example, surrounding turbine components. The combustion gases are channeled from combustion chamber 48 through guide cavity 72 and towards turbine nozzle 62. The hot gases impacting first stage turbine nozzle 62 create a rotational force that ultimately produces work from turbine 2.

At this point it should be understood that the above-described construction is presented for a more complete understanding of exemplary embodiments of the invention, which is directed to the particular structure of injection nozzle assemblies 38 and 39. However, as each injection nozzle assembly 38, 39 is similarly formed, a detail description will follow referencing injection nozzle assembly 38 with an understanding the injection nozzle assembly 39 is similarly formed.

Figure 3:
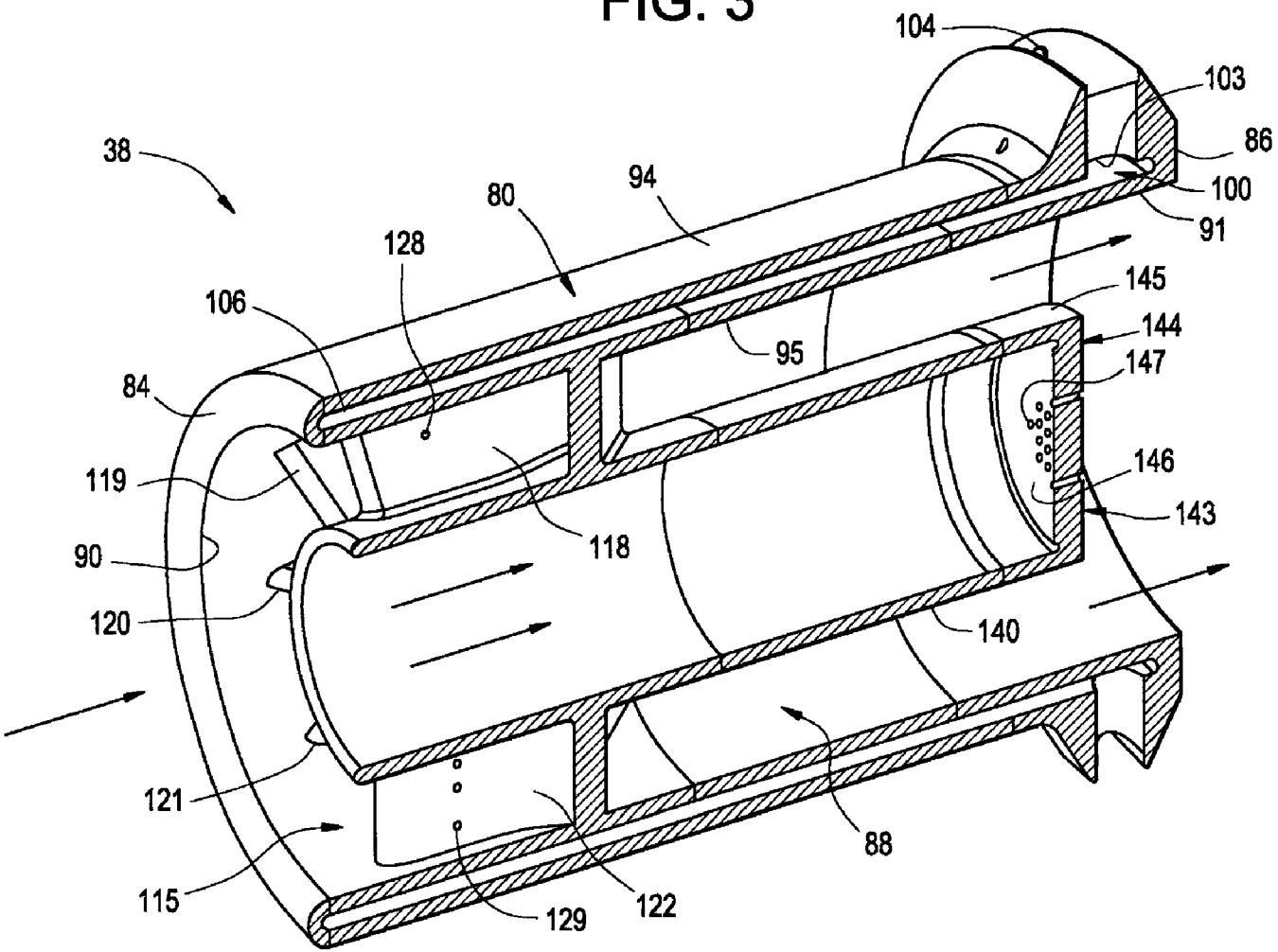
FIG. 3 is a cross-sectional view of a turbomachine nozzle formed in accordance with exemplary embodiments of the invention.
Figure 4:
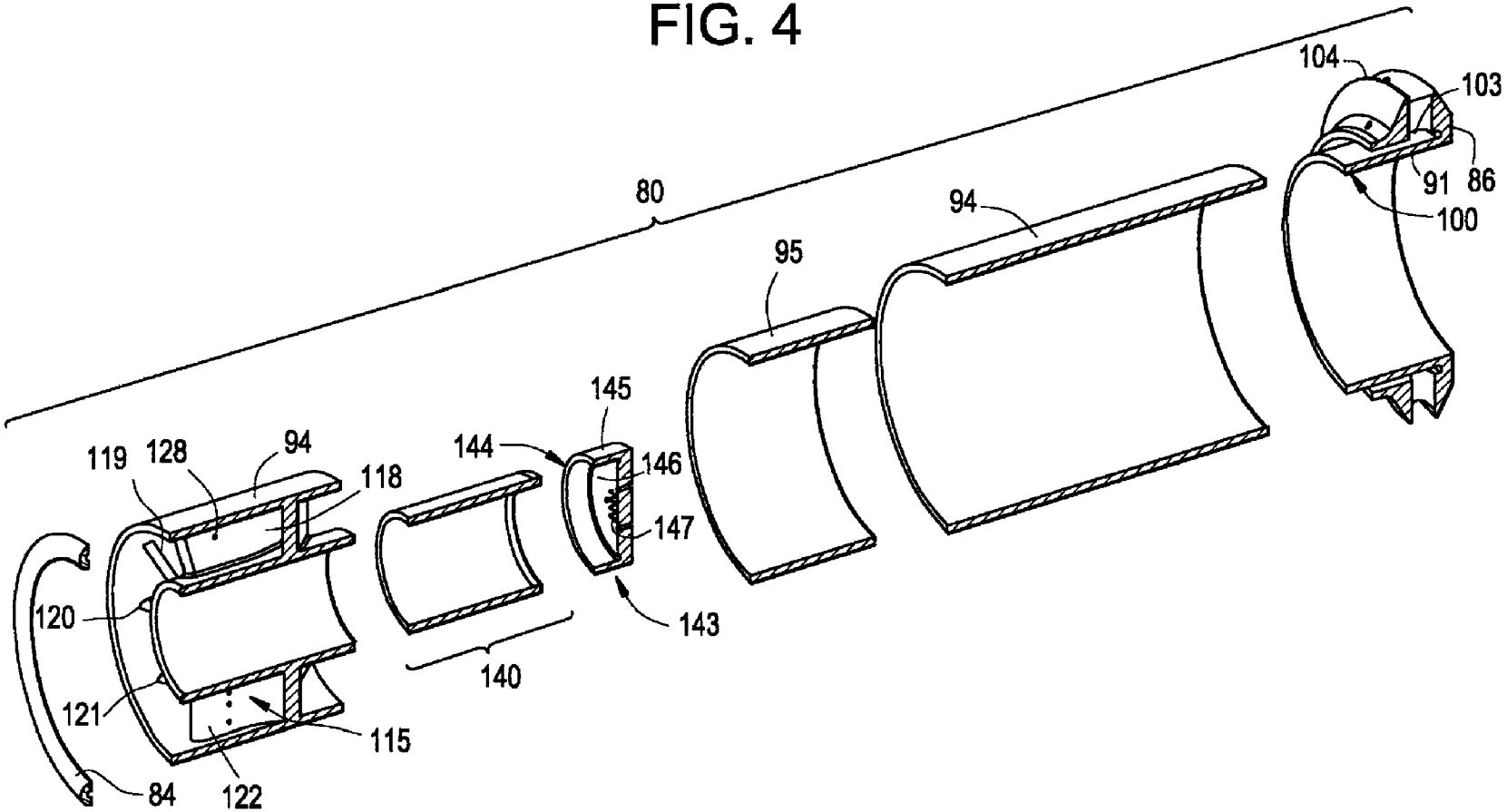
FIG. 4 is an exploded view of the turbomachine nozzle of FIG. 3.

As best shown in FIGS. 3 and 4, injection nozzle assembly 38 includes a main body 80 having a first end 84 that extends to a second end 86 defining an inner flow path 88. Main body 80 includes a first opening 90 positioned at first end 84 and a second opening or discharge 91 arranged at second end 86. Injection nozzle assembly 38 is mounted to cap member 34 within combustion chamber 48. More specifically, second end 86 of main body 80 is connected to first surface 35 of cap member 34. As will be discussed more fully below, fuel enters second end 86 of nozzle assembly 38 and passes into inner flow path 88 to mix with air prior to being combusted within combustion chamber 48. With this configuration, any necessary fuel inlet fittings on end cover 30 are significantly reduced. In addition, mounting nozzle assembly 38 to cap member 34 enables the use of an increased number of nozzle assemblies while, simultaneously, decreasing the complexity of end cover 30.

As further shown in FIGS. 3 and 4, injection nozzle assembly 38 includes an outer flow sleeve 94 and an inner flow sleeve 95. Inner and outer flow sleeves 94 and 95 are connected to define an annular fuel plenum 100. As shown, fuel plenum 100 includes a first or inlet end portion 103 having a plurality of openings 104 and a second end 106. Injection nozzle assembly 38 also includes a swirler or turbulator member 115 having a plurality of flow vanes 118-122 that are fluidly connected to annular fuel plenum 100. More specifically, flow vanes 118-122 include a plurality of discharge ports, such as shown at 128 in connection with vane 118 and at 129 shown in connection with vane 122 that lead to annular fuel plenum 100. With this arrangement, fuel passes through opening 104 and into annular fuel plenum 100. The fuel flows within annular fuel plenum 100 to second end 106. The fuel then passes into flow vanes 118-122 before exiting discharge ports 128 and 129 to mix with air passing through inner flow path 88.

Figure 5:
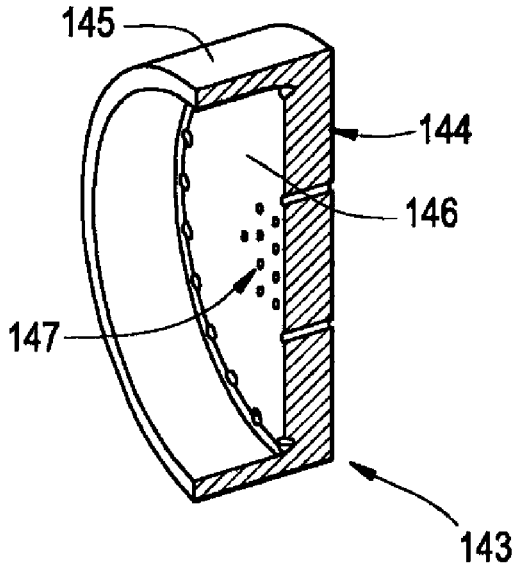
FIG. 5 is a cross-sectional view of an exemplary embodiment of a flow tip portion of the turbomachine nozzle of FIG. 3.
Figure 6:
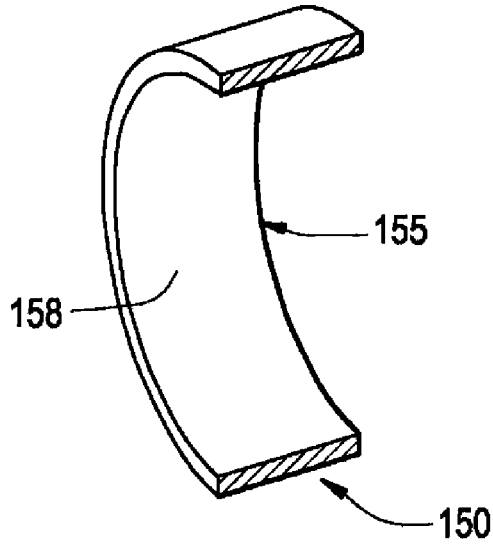
FIG. 6 is a cross-sectional view of an exemplary embodiment of another flow tip portion of the turbomachine nozzle of FIG. 3.
Figure 7:
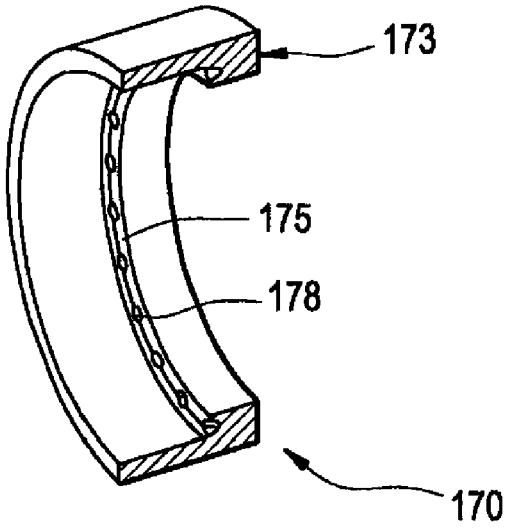
FIG. 7 is a cross-sectional view of an exemplary embodiment of yet another flow tip portion of the turbomachine nozzle of FIG. 3.

In further accordance with the exemplary embodiment shown, fuel nozzle assembly 38 includes a flow cartridge 140 that extends longitudinally through inner flow path 88. Flow cartridge 140 includes a flow tip 143 positioned adjacent to second end 86 of fuel nozzle assembly 38. As best shown in FIG. 5, flow tip 143 includes a main body 144 having an annular wall 145 and a terminal end 146. Terminal end 146 is provided with a plurality of openings indicated generally at 147. With this configuration, flow tip 143 establishes a baseline tip provided on flow cartridge 140. In addition to baseline flow tip 143, flow cartridge 140 can be provided with a variety of other flow tips depending upon desired combustion characteristics and/or emission control. For example, as shown in FIG. 6, a flow tip 150 includes a main body 155 having a substantially smooth interior surface 158. With this arrangement, flow tip 150 defines a non-swirled flow tip in which a portion of air flowing through flow cartridge 140 remains substantially unturbulated. Conversely, flow cartridge 140 can be provided with a swirled flow tip such as indicated at 170 in FIG. 7. Flow tip 170 includes a main body 173 having an annular rib 175 provided with a plurality of turbulator members 178. Flow tip 170 imparts a swirling action on the portion of air flowing within flow cartridge 140. In addition to the above, flow tips 150 and 170 are designed to accept optional components such as components that provide additional gas or liquid flow circuits, igniters, flame detectors, and the like.

At this point, it should be understood that the above-described exemplary embodiments provide an injection nozzle assembly that increases flexibility of combustor geometry allowing for an increased number of fuel injectors, decreased complexity of end cover geometry. In addition, the injection nozzle assembly enables the use of a single fuel circuit that supplies fuel to each combustor and allows for a single fuel circuit. It should also be understood that the turbomachine shown in connection with exemplary embodiment of the invention is but one example. Other turbomachines including a fewer or greater number of combustors and/or injector assemblies can also be employed. In addition, it should be understood that the cap member can be configured to support only a single injector assembly or any number of injector assemblies that can be mounted.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbomachine comprising:

a compressor;

a turbine;

a combustor operatively connected to the turbine;

an end cover mounted to the combustor;

a cap member positioned within the combustor, the cap member including a first surface and a second surface;

a combustion chamber defined within the combustor; and at least one injection nozzle supported at the second surface of the cap member, the at least one injection nozzle including a main body having a first end that extends through an inner flow path to a second end, and an annular fuel plenum having at least one fuel inlet arranged at the second end and at least one discharge port arranged adjacent the first end, the first end being configured to receive an amount of a first fluid and the annular fuel plenum being configured to receive an amount of a second fluid through the at least one fuel inlet, the second end discharging a mixture of the first and second fluids from the injection nozzle into the combustion chamber.

2. The turbomachine according to claim 1, wherein the at least one injection nozzle includes an inner flow cartridge, the inner flow cartridge including a flow tip that imparts a flow characteristic to the first fluid.

3. The turbomachine according to claim 2, wherein the flow tip is a non-swirled tip.

4. The turbomachine according to claim 2, wherein the flow tip is a swirled tip, the swirled tip including an internal rib member.

5. The turbomachine according to claim 2, wherein the flow tip is a baseline tip, the baseline tip including a wall portion having formed therein a plurality of openings.

6. The turbomachine according to claim 1, wherein the at least one injection nozzle further includes an inner flow sleeve and an outer flow sleeve, the inner flow sleeve being mounted to the outer flow sleeve so as to define the annular fuel plenum.

7. The turbomachine according to claim 1, wherein the at least one injection nozzle includes a turbulator member having a plurality of flow vanes, the turbulator member being arranged along the inner flow path of the at least one injection nozzle.

8. The turbomachine according to claim 7, wherein the at least one discharge port includes a plurality of discharge ports, each of the plurality of flow vanes includes at least one of the plurality of discharge ports.

9. An injection nozzle for a turbomachine comprising:

a main body having a first end that extends through an inner flow path to a second end, and an annular fuel plenum having at least one fuel inlet arranged at the second end and at least one discharge port arranged adjacent the first end, the first end being configured to receive an amount of a first fluid and the annular fuel plenum being configured to receive an amount of a second fluid through the at least one fuel inlet, the second end discharging a mixture of the first and second fluids from the injection nozzle into a combustion chamber.

10. The injection nozzle according to claim 9, further comprising: an inner flow cartridge, the inner flow cartridge including a flow tip that imparts a flow characteristic to the first fluid.

11. The injection nozzle according to claim 10, wherein the flow tip is a non-swirled tip.

12. The injection nozzle according to claim 10, wherein the flow tip is a swirled tip, the swirled tip including an internal rib member.

13. The injection nozzle according to claim 10, wherein the flow tip is a baseline tip, the baseline tip including a wall portion having formed therein a plurality of openings.

14. The injection nozzle according to claim 9, further comprising: an inner flow sleeve and an outer flow sleeve, the inner flow sleeve being mounted to the outer flow sleeve so as to define the annular fuel plenum.

15. The injection nozzle according to claim 9, further comprising: a turbulator member having a plurality of flow vanes, the turbulator member being arranged along the inner flow path of the injection nozzle.

16. The injection nozzle according to claim 15, wherein: wherein the at least one discharge port includes a plurality of discharge ports, each of the plurality of flow vanes includes a at least one of the plurality of discharge ports.

17. A method of introducing a combustible mixture of a first and second fluid into a turbomachine nozzle including a main body having a first end that extends through an inner flow path to a second end mounted to a cap member, the method comprising:

guiding a first fluid through the first end of the injection nozzle;

introducing a second fluid into an annular fluid plenum extending about the injection nozzle at the second end;

passing the second fluid from the second end toward the first end through the annular fuel plenum;

guiding the second fluid into the first fluid between the first and second ends;

mixing the first and second fluids within the inner flow path to form a combustible mixture; and passing the combustible mixture through the second end into a combustion chamber.

18. The method of claim 17, wherein guiding the second fluid into the first fluid includes passing the second fluid through at least one flow vane.

* * * * *